United States Patent [19]

Papp et al.

[11] Patent Number: 4,566,814

[45] Date of Patent: Jan. 28, 1986

[54] PRINT HEAD CARRIAGE ASSEMBLY

[75] Inventors: John E. Papp, Anaheim; Bienvenido Nepomuceno, Diamond Bar, both of Calif.

[73] Assignee: Standard Precision, Inc., Santa Fe Springs, Calif.

[21] Appl. No.: 482,458

[22] Filed: Apr. 6, 1983

[51] Int. Cl.[4] ..... B41J 19/00

[52] U.S. Cl. ..... 400/354.1; 400/320

[58] Field of Search ..... 400/320, 352, 354, 354.1, 400/354.2, 354.3; 308/3.8, 6 R; 312/348

[56] References Cited

U.S. PATENT DOCUMENTS

| | | | |
|---|---|---|---|
| 576,359 | 2/1897 | Booth | 400/354.3 |
| 816,295 | 3/1906 | Brooks | 308/6 R X |
| 1,132,300 | 3/1915 | Briggs | 400/354.3 |
| 3,078,120 | 2/1963 | Faber | 308/6 R X |
| 3,205,025 | 9/1965 | Jordan | 312/348 X |
| 3,661,431 | 5/1972 | Wisechaver | 308/6 R |
| 4,200,342 | 4/1980 | Fall | 308/6 R X |
| 4,200,402 | 4/1980 | Rix | 400/354.1 |
| 4,201,423 | 5/1980 | Hagen et al. | 400/354 X |

FOREIGN PATENT DOCUMENTS

| | | | |
|---|---|---|---|
| 2904116 | 8/1980 | Fed. Rep. of Germany | 308/3.8 |
| 2922632 | 12/1980 | Fed. Rep. of Germany | 400/352 |
| 1216949 | 12/1970 | United Kingdom | 400/354 |

OTHER PUBLICATIONS

IBM Technical Disclosure Bulletin, "Carrier Support Device", Bernard et al., vol. 20, No. 2, Jul. 1977, pp. 567–568.

IBM Technical Disclosure Bulletin, "Trolley/Rail Mechanism for Printers", Kacmarcik et al., vol. 25, No. 10, Mar. 1983, pp. 5377–5378.

*Primary Examiner*—Ernest T. Wright, Jr.

*Attorney, Agent, or Firm*—Edgar W. Averill, Jr.

[57] ABSTRACT

A print head carriage assembly having a precision, linear, ball-bearing slide mounted parallel to the platen. The device has a carriage which is supported by the inner member of the slide. The linear movement of the carriage is also controlled by a second guide which is likewise mounted parallel to the platen.

15 Claims, 16 Drawing Figures

FIG. 3.
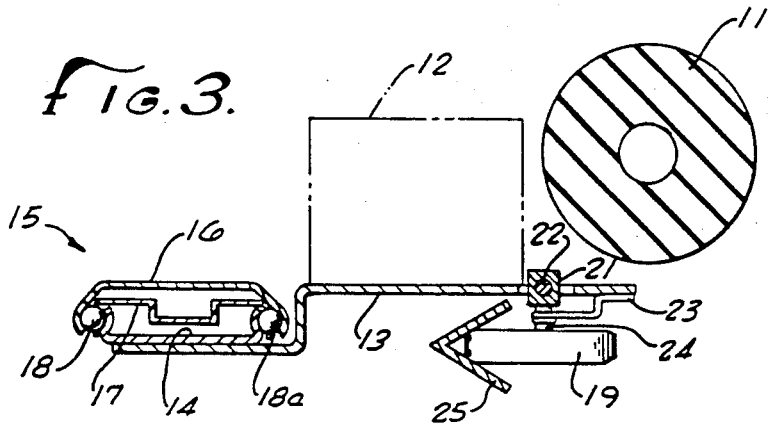
FIG. 4.
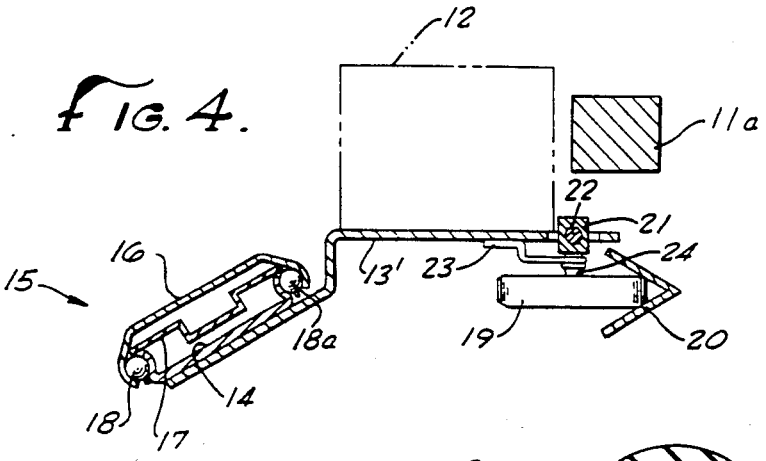
FIG. 5.
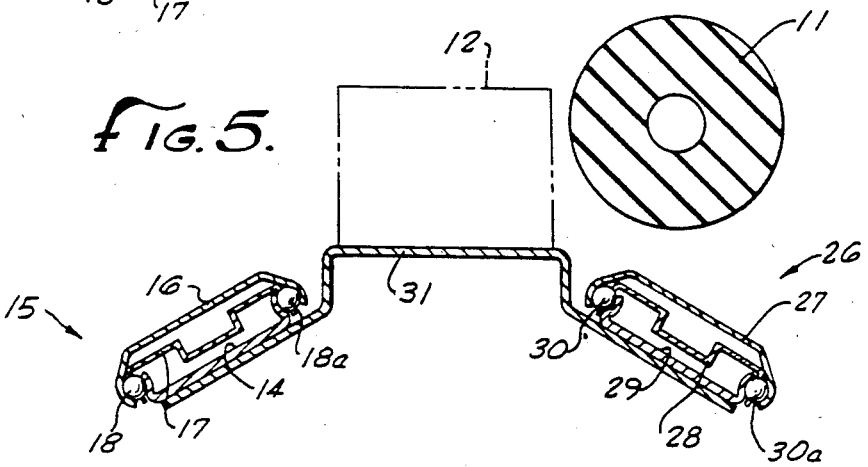
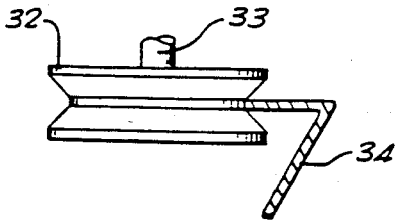
FIG. 6.

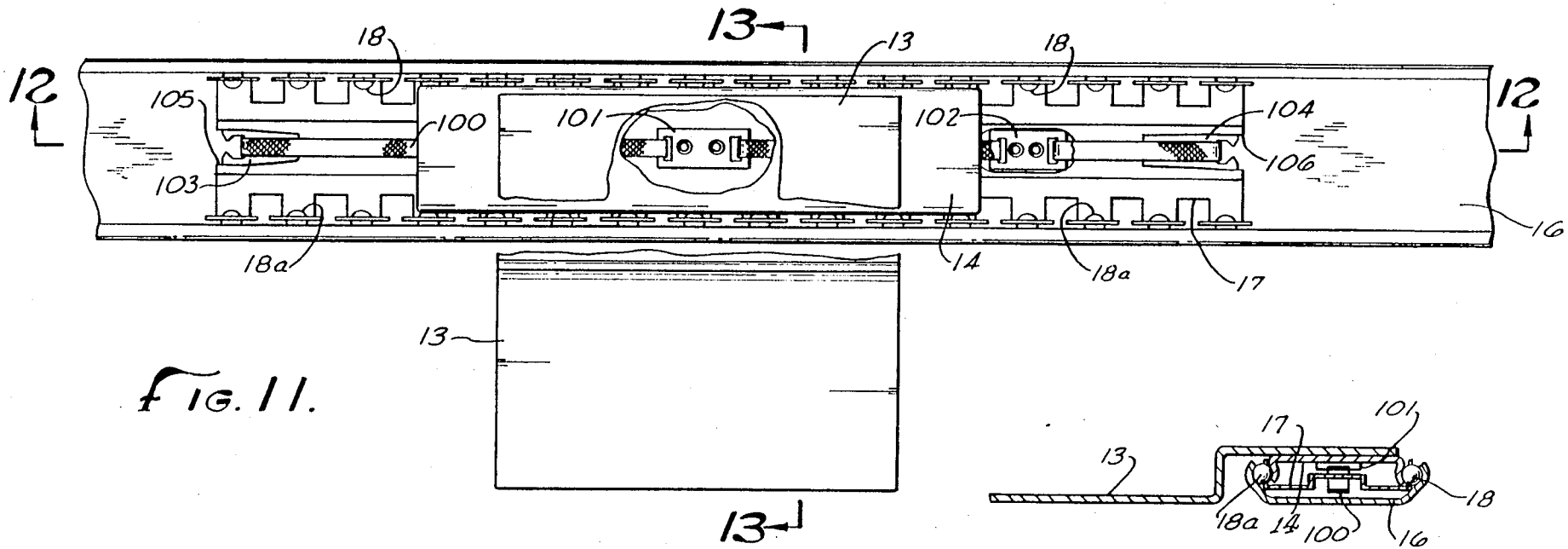
FIG. 11.
FIG. 13.
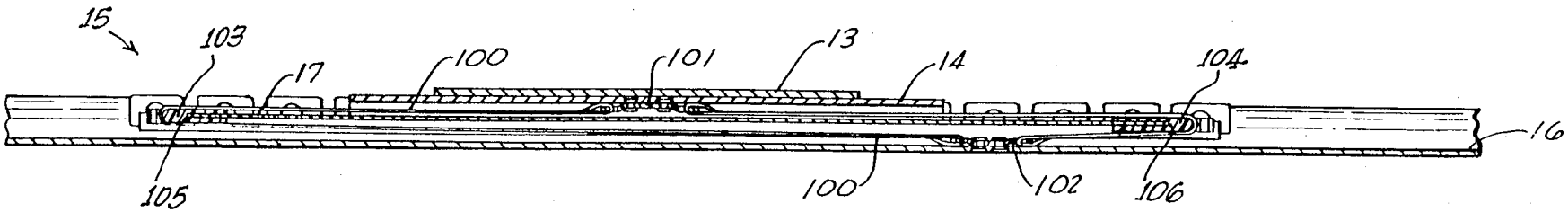
FIG. 12.

PRINT HEAD CARRIAGE ASSEMBLY

BACKGROUND OF THE DISCLOSURE

The field of the invention is serial printers and the invention relates more specifically to assemblies for holding and controlling the movement of the print head.

With the increased use of computers and word processors, there has been an increased interest in devices which convert the electronic data to a permanent image on paper. Teletype machines and electric typewriters have given way to daisy wheel, dot matrix and ink jet printers. While such serial printers are capable of far higher print speeds than the earlier types of printers, there is always a desire to further increase print speeds. Other types of print heads have been developed and will continue to be developed which also require that the print head be driven along the paper at speeds which are higher than those possible with the present devices. Furthermore, the printer manufacturing business has become very competitive and there is a need to reduce production cost to stay competitive.

For all serial printing methods, it is essential that the print head be moved parallel to the surface of the platen against which the paper or other printing substrate is held. It is therefore common for the print head to be mounted on a carriage which is moved by a guide means along the platen. Typically the carriage is held by two bearings which ride on two ground steel rods which are mounted on the frame of the printer. Typically, the mounting position of these rods is adjustable so that the final unit may provide an exact parallel movement of the print head with respect to the platen. Such adjustment, of course, is time consuming and the ground steel rods are themselves expensive. A commonly used bearing surrounds the steel rod and is fabricated from a polymer having a low coefficient of friction against the ground steel rod. A commonly used second bearing is another block of polymer having a U-shaped groove therein which is pressed against the second steel rod. Another commonly used bearing is a bronze bushing riding on a steel rod. The inherent rubbing friction of these carriage bearing surfaces would limit the speed at which the printer may be operated. Rubbing friction creates heat which tends to expand the mating members generating more friction. This condition generally requires larger print head drive motors to overcome the friction at higher speed. Therefore, the print speed for such units must be limited to that which does not generate sufficient heat to create this problem. The steel rods are also relatively heavy and the increased weight increases shipping, packaging and handling costs.

In addition to cost and print speed limitations, the standard ground steel rod mounting system is expensive both to manufacture and to assemble. Still further, the friction between the bearings and the rods requires a larger than necessary drive motor. There is thus a need for an improved apparatus for mounting the print head.

One such improved system is shown in U.S. Pat. No. 4,201,423 assigned to the assignee of the present application. This device discloses two or more precision, linear, ball-bearing slides held in special end-alignment support caps and the carriage is held by the inner slide member of the two or more slides. This system, although useful for some applications, is not capable of being used for all applications because of the space required to mount the two or more slides and the end alignment support caps. Furthermore, a lower cost system is required for some applications.

SUMMARY OF THE INVENTION

It is thus an object of the present invention to provide a print head carriage assembly capable of high speed operation which is both low in initial cost and which requires a minimum of labor to install in a printer.

The present invention is for an improved printing device of the type having a platen mounted on a frame and a moveable print head mounted on a carriage which is driven in a path which is parallel to the platen. The improvement comprises a precision, linear, ball-bearing slide having an outer race member and an inner race member which has the carriage affixed thereto. The slide also has a ball retainer and the outer race member is mounted on a frame so that it is parallel to the platen. A support arm is affixed to the carriage and cooperates with the guide means also affixed to the frame and mounted parallel to the platen. The guide means has a fixed member (which is the member mounted on the frame) and a movable member which is attached to the support arm of the carriage. Biasing means are positioned between the inner race member of the slide and the movable member of the guide means. In a preferred embodiment, the slide carriage and guide means are all mounted on a set-in frame which can be pre-assembled and merely dropped in the printer by the printer manufacturer without the need for any adjustment.

BRIEF DESCRIPTION OF THE DRAWINGS

FIG. 3 is a cross-sectional side elevation analogous to FIG. 2 showing an alternate embodiment of the present invention.

FIG. 4 is a cross-sectional side elevation analogous to FIG. 2 showing an alternate embodiment of the present invention.

FIG. 5 is a cross-sectional side elevation analogous to FIG. 2 showing an alternate embodiment of the present invention.

FIG. 6 is a fragmentary side elevation partly in cross section showing an alternate embodiment of the guide roller and channel of the device of FIG. 1.

FIG. 11 is an enlarged fragmentary bottom plan view, partly cut away, of the slide and carriage assembly of FIG. 1.

FIG. 12 is a cross-sectional view taken along line 12—12 of FIG. 11.

FIG. 13 is a cross-sectional view taken along line 13—13 of FIG. 11.

DESCRIPTION OF THE PREFERRED EMBODIMENTS

Figure 1:
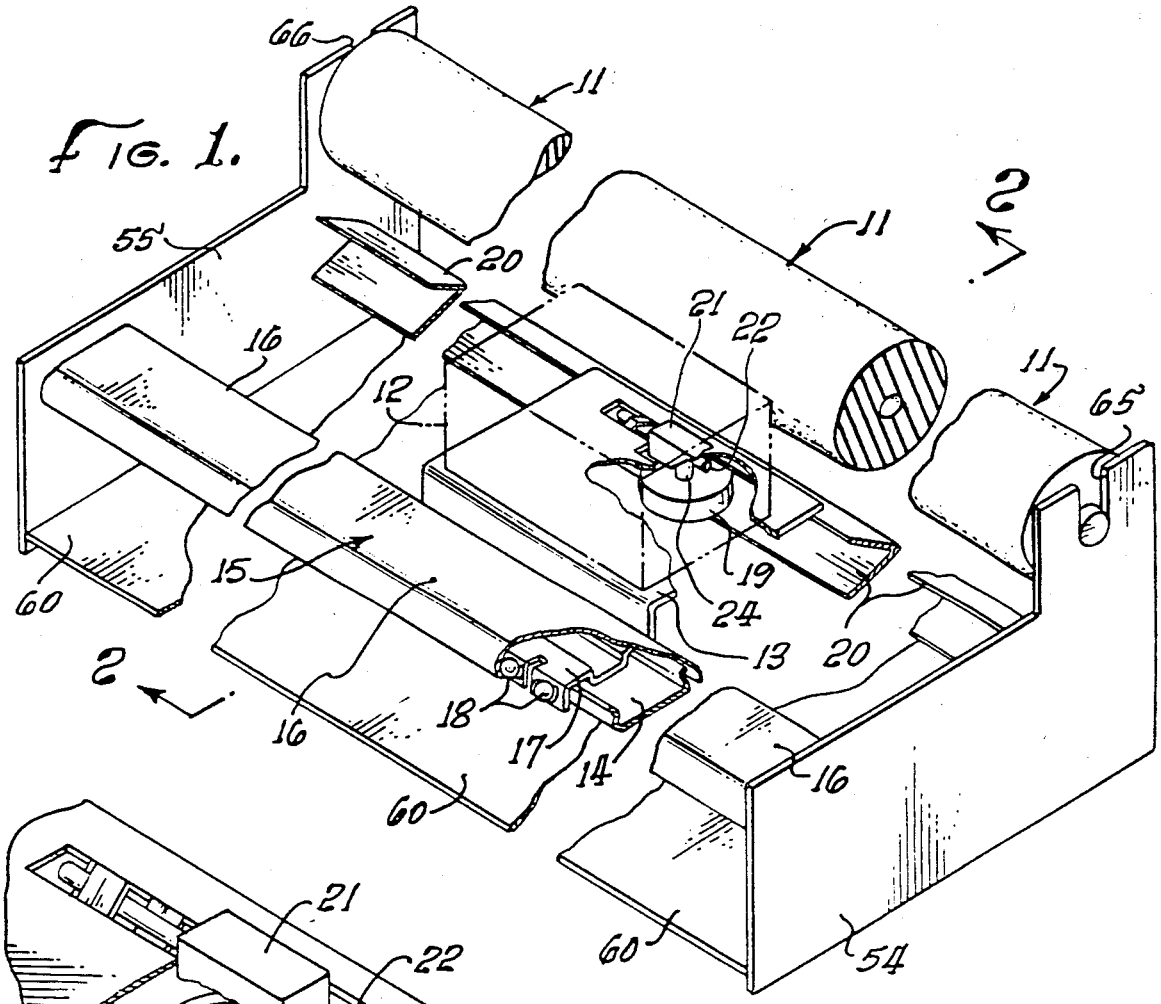
FIG. 1 is a perspective view partly cut away of the print head carriage, assembly support and guide means of the present invention.
Figure 2:
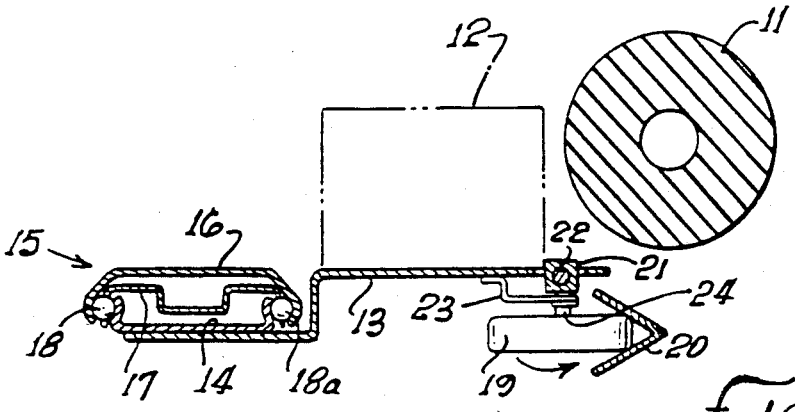
FIG. 2 is a cross-sectional view taken along line 2—2 of FIG. 1.

The device shown diagrammatically in FIGS. 1 and 2 is a print head carriage assembly and platen of the type used commonly for printers of the type commonly used with computers. Such printers are often daisy wheel printers or dot matrix printers and they may have a platen 11 which is cylindrical and turns with the paper similar to those used in conventional typewriters for many years or they may have a stationary platen which has the paper drawn across it. Platen 11 is mounted in slots 65 and 66 of end walls 54 and 55. The location of the print head is indicated by phantom lines 12 and the print head 12 rides on a platform 13. The particular type of print head is not critical in using the device of the present invention. The carriage assembly of the present invention is capable of withstanding a relatively large amount of impact for a long duration such as that provided by a daisy wheel printer.

A carriage assembly for print head 12 is shown in side view in FIG. 2 and consists of a movable platform 13 which is held by an inner slide or race member 14 which forms a pair of inner races and by a movable arm or shaft 24 supported by a movable guide wheel or member 19 which rides in a fixed channel or member 20 as discussed more fully below.

Platform 13 is affixed to an inner slide member 14 by rivets, welding or other conventional attachment technique. Inner slide member 14 is part of a prior art slide assembly indicated generally by reference character 15. Such slide assemblies are shown in U.S. Pat. No. 3,205,025 issued to Fred A. Jordon and assigned to the assignee of the present invention. Such slide assemblies will be referred to herein as precision, linear, ball bearing slide assemblies. Slide assembly 15 has an outer slide member 16 affixed to side walls or panels 54 and 55 which are affixed to bottom plate 60, a ball retainer 17 and a plurality of ball bearings 18.

The inner slide member 14 should be sufficiently long so that it simultaneously contacts a sufficient number of ball bearings 18 on each side so that it moves smoothly and precisely along the race of outer slide member 16. It is preferably that ball retainer 17 be provided with means for synchronizing its movement with respect to the inner slide member 14. Such a synchronization device is shown in FIGS. 11, 12 and 13 and is discussed more fully below.

Figure 1A:
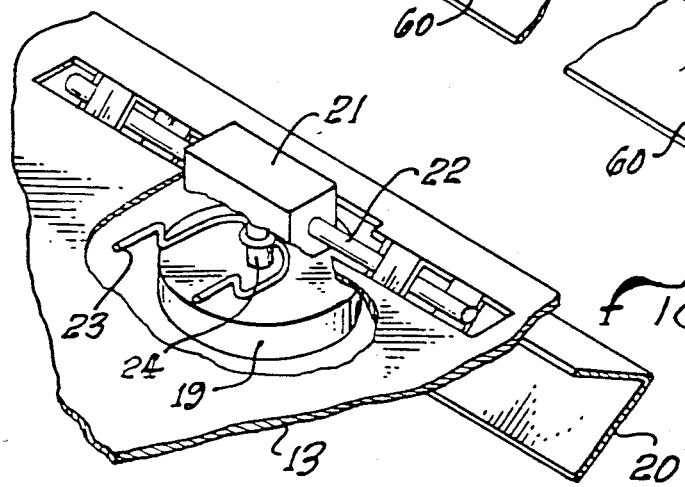
FIG. 1*a* is an enlarged perspective view partially cut away of the roller means and support arm of the print head carriage assembly of FIG. 1.

The other side of platform 13 is supported by a guide roller or wheel 19 which rides along the interior surface of "V" shaped channel 20 which, in turn, is staked or otherwise affixed to side walls 54 and 55. Guide roller 19 is biased or spring loaded so that it urges platform 13 either toward slide assembly 15 or away from it. Such biasing tends to take up any slack or flex in the assembly 15 and compensates for wear. If the print head 12 provides a substantial impact, it is preferable that the biasing be in the direction shown in FIG. 2 and indicated by the arrow since this would tend to hold the ball bearings 18 along the exterior race of outer slide member 16 tightly against the race. The biasing method shown in the drawing is merely diagrammatic since the particular assembly does not constitute a portion of the present invention. Guide roller 19 is mounted on shaft 24 which is held by a block 21. As shown in FIG. 1*a*, block 21 is rotatively supported by a support shaft 22 and thus roller 19 pivots about the axis of a shaft 22 as well as rolling with respect to shaft 24. A spring 23 urges roller 19 against the channel 20.

Guide roller 19 guides the platform 13 as it travels along its path of travel parallel to platen 11. Roller 19 is typically fabricated from a polymer having good wear characteristics such as nylon. A roller shaft 24 provides a support arm for the carriage asembly since it holds one side of platform 13 in its desired vertical position.

An alternate biasing direction is shown in FIG. 3 where roller 19 is biased toward channel 25 which is positioned between roller 19 and slide assembly 15. With this direction of biasing, any wear which occurs in slide assembly 15 will be taken up in the direction of ball bearings 18*a* and thus there will be no rocking or inaccuracy of the precision movement of inner slide member 14. The choice of direction of biasing involves several factors including space availability and amount of anticipated impact. As stated above, if there is a large amount of impact caused by the movement of the print head 12, then the biasing direction shown in FIG. 2 is preferable to that in FIG. 3. After a certain amount of wear, there will be a minute amount of movement capable away from the direction of biasing and it is preferable to have the impact in the same direction as the biasing so that it will not result in any slack.

An alternate mounting position of slide assembly 15 is shown in FIG. 4 where the slide assembly 15 is mounted on platform 13′ at an angle between 30 and 45 degrees with respect to the horizontal. The optimum mounting angle is a mounting whereby the resultant force vector from the print head 12 is parallel to an imaginary line drawn through the centers of the ball bearings 18 and 18*a* since the slide assembly 15 is in its most efficient position to resist the vector force in this direction. A stationery platen 11*a* is illustrated adjacent print head 12.

Another print head mounting method is shown in FIG. 5 and this orientation is an ideal one from a support standpoint but unfortunately requires a larger amount of space for mounting than the devices of FIGS. 1 through 4. In FIG. 5, slide 26 has an outer race or slide member 27, a ball retainer 28, an inner race or slide member 29 and two rows of ball bearings 30 and 30*a*. The platform 31 is affixed to the inner races or slide members 29 and 14 and the outer races or slide members 16, 27 are securely affixed to the frame on which the device is mounted.

It is highly desirable that the print head carriage assembly and the platen 11, 11*a* be securely mounted on a single frame so that adjustment of these elements is not necessary to provide alignment. That is, if the slide and guide members 14, 16, 20, 25 and the platen 11, 11*a* are accurately located in the initial manufacturing stages, it is unnecessary to provide adjustment at any later time. Most prior art devices were not fabricated this way and a considerable amount of time was required to align the print head movement with the platen.

While the guide method used in the devices in FIGS. 1 through 4 was a roller 19 riding in a "V" shaped channel 20, 25, it is possible, of course, to have other types of guide means. One such alternate device is shown in FIG. 6 where a grooved roller 32 rotates about its shaft 33 and is held by a support bar 34 which constitutes channel means affixed to the frame. Roller 32 could, of course, be biased so that it urges the roller 32 in the direction of the support bar 34 and takes up any slack caused by wear after extended use of the device.

Figure 7:
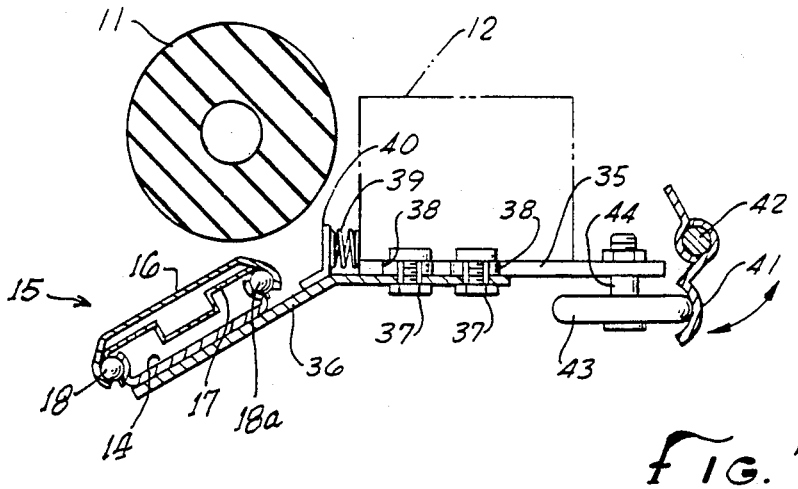
FIG. 7 is a cross-sectional side elevation showing an alternate embodiment of the print head carriage assembly of the present invention.

For many printer operations, it is desirable to provide a means for adjusting the distance between the print head and the platen. The device shown in FIG. 7 provides such adjustment. The print head is located again in the area of the phantom lines 12 and is supported by platform 35 which is held on plate 36 by a plurality of bolts 37. Bolts 37 ride in slots 38 formed in platform 35 so that platform 35 is able to move with respect to plate 36. A spring 39 is held on a spring mounting plate 40 and urges platform 35 toward rotatable channel 41. Channel 41 rotates about shaft 42 and the turning of shaft 42 moves platform 35 as described more fully below. Roller 43 turns about its shaft 44 which is bolted to platform 35. Thus, the printing device would be made in such a way that the user could adjust the angular position of shaft 42 to correct for the thickness or number of copies of the printing medium.

Figure 8:
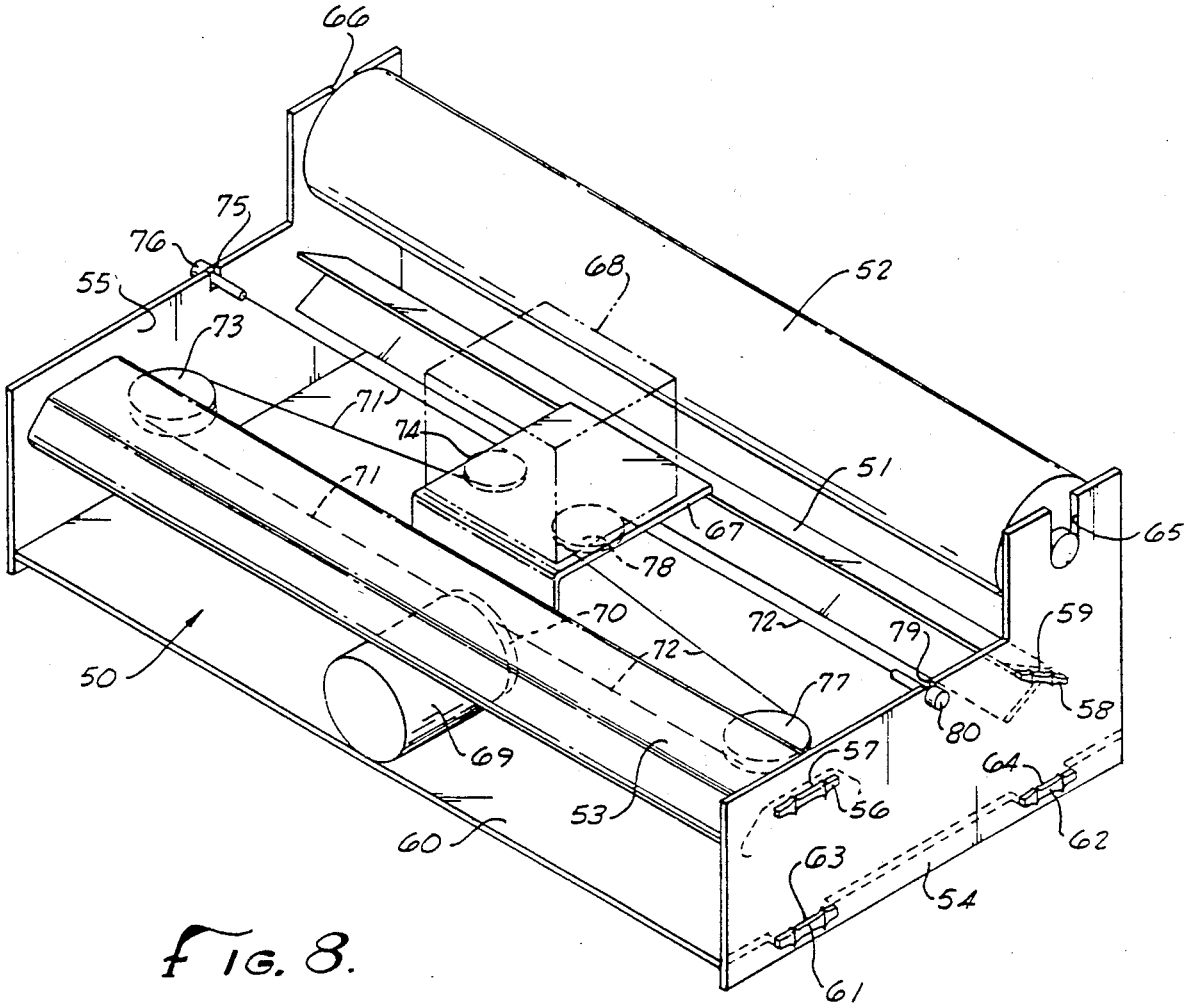
FIG. 8 is a perspective view showing a drop-in print head carriage and platen assembly of the present invention.

As mentioned above, a substantial benefit results from the providing of a print head carriage assembly and platen assembly which is prefabricated in a manne which provides for the parallel mounting of the precision, linear, ball bearing slide assembly 50, the guide channel 51 and the platen 52 in FIG. 8. One method of providing such an assembly results from the staking of the slide guide channel 51 and a base plate 60 to a pair of side frames or panels 54, 55. More specifically, outer race or slide member 53 is staked to side panels 54 and 55 by expanding tab 56 in slot 57. Similarly, tab 58 of guide channel 51 is expanded in slot 59 of outside panel 54. The bottom plate 60 has tabs 61 and 62 which are expanded in slots 63 and 64. Similarly, the same attachment of the outer race or slide member 53, guide channel 51 and bottom plate 60 is made to side panel 55. The platen 52 is accurately supported in slots 65 and 66. Other fastening methods such as welding, riveting, bolting and the like may, of course, be used.

In this manner, the movement of platform 67 is fixed so that it is always parallel to the surface of platen 52. This entire assembly shown in FIG. 8 can then be dropped into the printer chassis and the appropriate electrical connections made and no further alignment is necessary. This ability greatly decreases the fabrication and installation costs and results in a more accurately aligned printer.

Various methods of driving the print head located in phantom lines 68 are possible. One such method is indicated diagrammatically in FIG. 8 where drive motor 69 turns a spool 70 on which cables 71 and 72 are affixed. Drive motor 69 is, of course, securely mounted to the frame in any conventional manner. The turning of spool 70 then draws in or releases cables 71 and 72. Cable 71 passes over sheaves 73 and 74 and is held in a slot 75 by a boss 76 securely affixed to the free end of cable 71. Similarly, cable 72 passes over sheaves 77 and 78 and is held in slot 79 by boss 80. Of course, a direct drive method, belt or chain drive, or other drive system will operate in conjunction with the present invention.

The providing of a drop-in type of unit such as that shown in FIG. 8 has the further advantage of facilitating service since the entire unit can be made readily removable from the chassis of the printer or typewriter and in repair a new or rebuilt unit may be used to replace a damaged unit.

Figure 9:
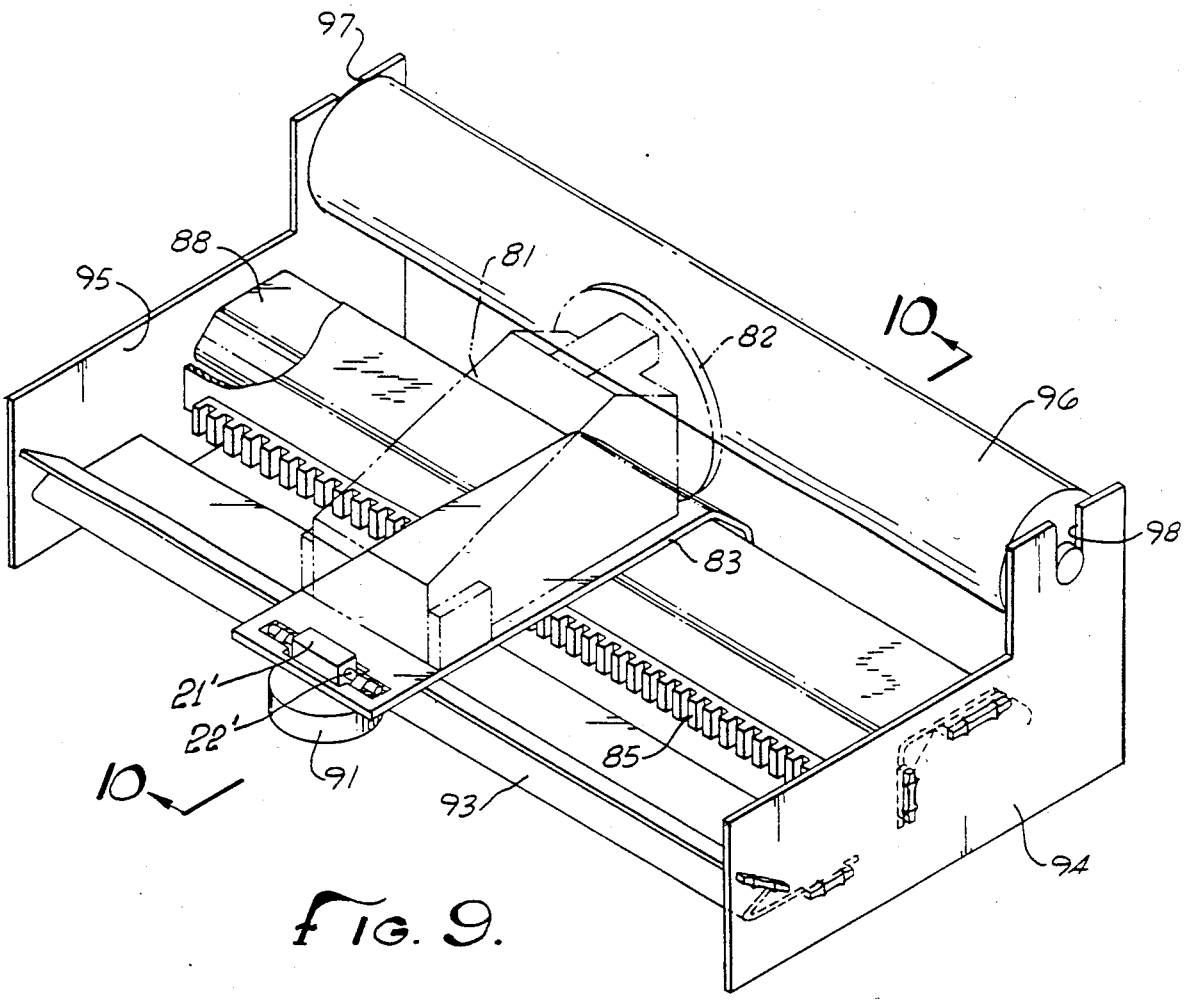
FIG. 9 is a perspective view showing an alternate embodiment of the drop-in print head carriage assembly of the present invention.
Figure 10:
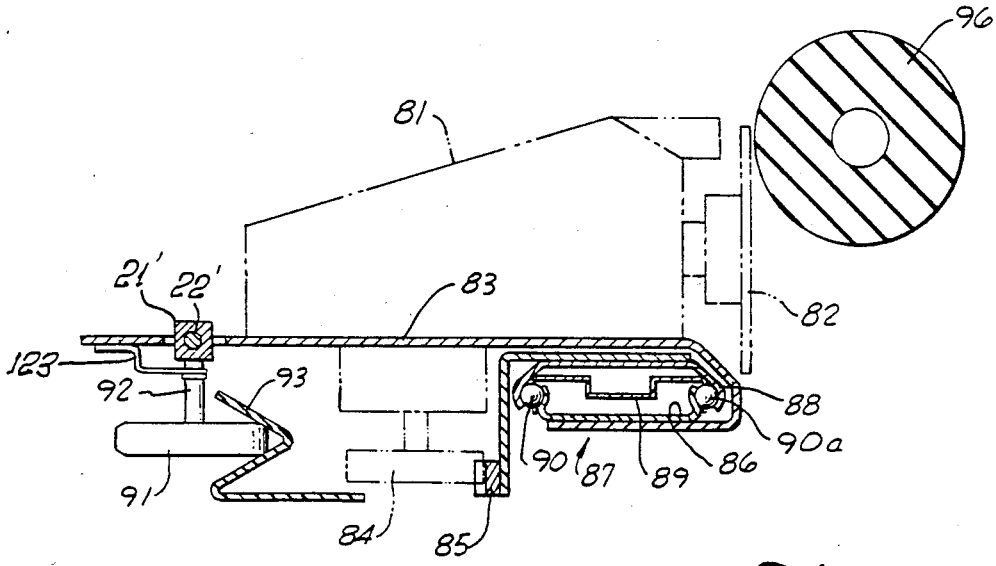
FIG. 10 is a cross-sectional side elevation taken along line 10—10 of FIG. 9.

The mounting method of the present invention may also be used with different drive methods. A gear driven unit is shown in FIG. 9 where the print head 81 and daisy wheel 82 are held on platform 83. Platform 83 is driven by a spur gear 84 (see FIG. 10) which rides along rack 85. Platform 93 is supported by the inner race or slide member 86 of precision, linear, ball bearing slide assembly 87. Slide assembly 87 also has an outer race or slide member 88, a ball retainer 89 and two rows of ball bearings 90 and 90*a*. The other or opposite edge of platform 83 is supported by a roller 91 which is mounted on shaft 92 which is biased by spring 123 to urge the roller 91 towards the "V" shaped channel 93. Shaft 92 is held by block 21′ which is pivotally held on support shaft 22′. "V" shaped channel 93 and slide assembly 87 are fastened to side plates 94 and 95. Platen 96 is held in slots 97 and 98 in side plates 95 and 94.

It is preferable that the slides be mounted so that the outer race is facing generally downwardly. This helps reduce the possibility that debris will fall into the slide and interfere with the movement of the ball bearings. This direction of mounting, however, is not essential for the practice of the present invention and other means of preventing entry of foreign matter may be used.

As stated above, the synchronization of movement of the ball retainer with respect to the inner slide member is preferred to prevent any sliding friction between the ball bearings and their respective races. That is, if the inner slide member and the ball retainer are out of alignment, the ball retainer can reach the end of the slide before the inner slide member and it is then necessary for the inner slide member to slide rather than roll with respect to the ball bearings 18, 18*a*. This causes an increase in friction and in a delicate printer operation might cause a lack of uniformity of print head movement. Thus, some method of synchronization is desirable and the method shown in FIGS. 11 through 13 is a particularly simple method for carrying out this synchronization. A flexible belt 100 is affixed to a belt bracket 101 which is riveted or otherwise attached to inner slide member 14 and is also attached to bracket 102 which is affixed to outer slide member 16. Belt 100 may be a woven nylon or other flexible belt which has a good wear characteristics. The attachment of brackets 101 and 102 is shown in side cross-sectional view in FIG. 12. Belt 100 passes over to bearings 103 and 104 which are held in slots 105 and 106 in ball retainer 17. Bearings 103 and 104 are preferably made from a polymer having a high degree of slip such as nylon so that there is a minimum of friction between the belt 100 and the bearings 103, 104. It can thus be seen that the movement of inner slide member 14 causes ball retainer 17 to move in the direction of the movement of the inner slide member 14 a distance of one half of the travel of the inner slide member 14.

Figure 14:
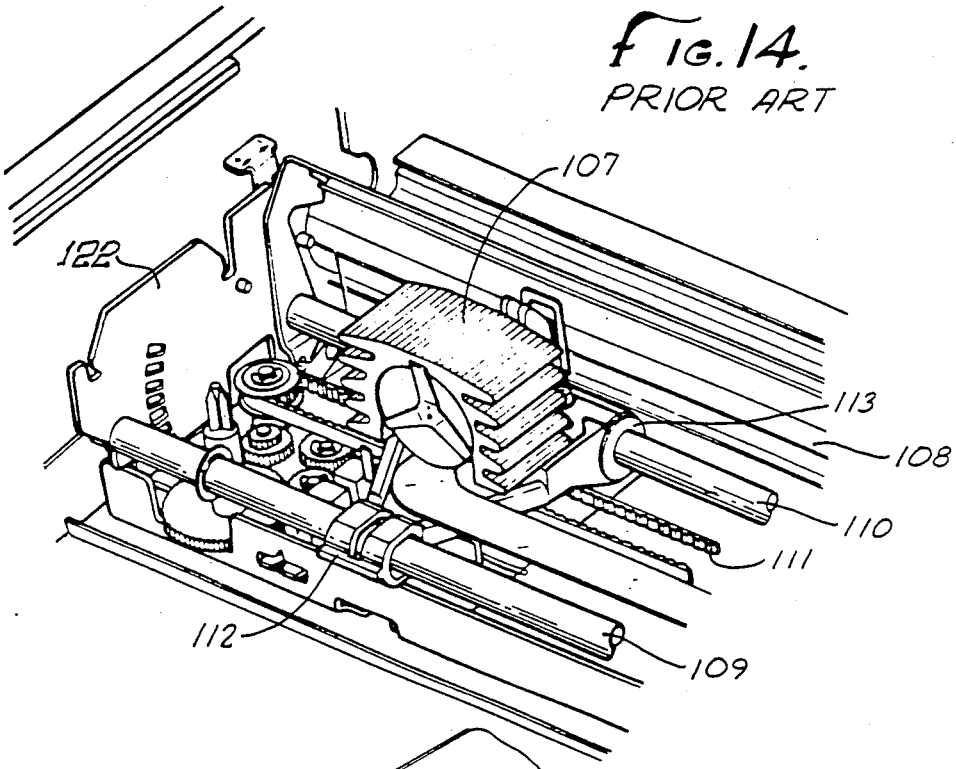
FIG. 14. PRIOR ART
FIG. 14 is a perspecive view, partly cut away, of a prior art print head carriage assembly.

FIG. 11 also shows the length of the inner slide member 14 and it can be seen that the member 14 is supported by a plurality of ball bearings 18, 18*a* along each side which provides sufficient support for assuring a smooth movement of member 14. In order to appreciate the advance which the present invention constitutes, it is necessary to discuss the presently used printer carriage mechanisms. One widely used mechanism is shown in FIG. 14 where the dot matrix print head 107 is carried in a parallel path with respect to platen 108. Print head 107 is supported by two ground steel shafts 109 and 110 and is driven by belt 111. Shafts 109 and 110 are affixed to two metal side panels, one of which is shown in FIG. 14 and indicated by reference character 122. The carriage of print head 107 is held by a bearing 112 which rides on shaft 109 and a second bearing 113 which rides on shaft 110. Although these bearings 112 and 113 are lubricated, there is a relatively high degree of friction between them and the shafts 109 and 110 as compared to the ball-bearing movement of the slide used in the device of the present invention. This friction limits the speed at which the print head 107 may be driven. By further increase in the speed, a certain amount of heat is generated in the bearings 112 and 113 which causes an expansion of one or both of the shafts 109 and 110 which tends to drive the shafts 109 and 110 out of alignment. It was thus then believed necessary to limit print head speed because of this problem.

Figure 15:
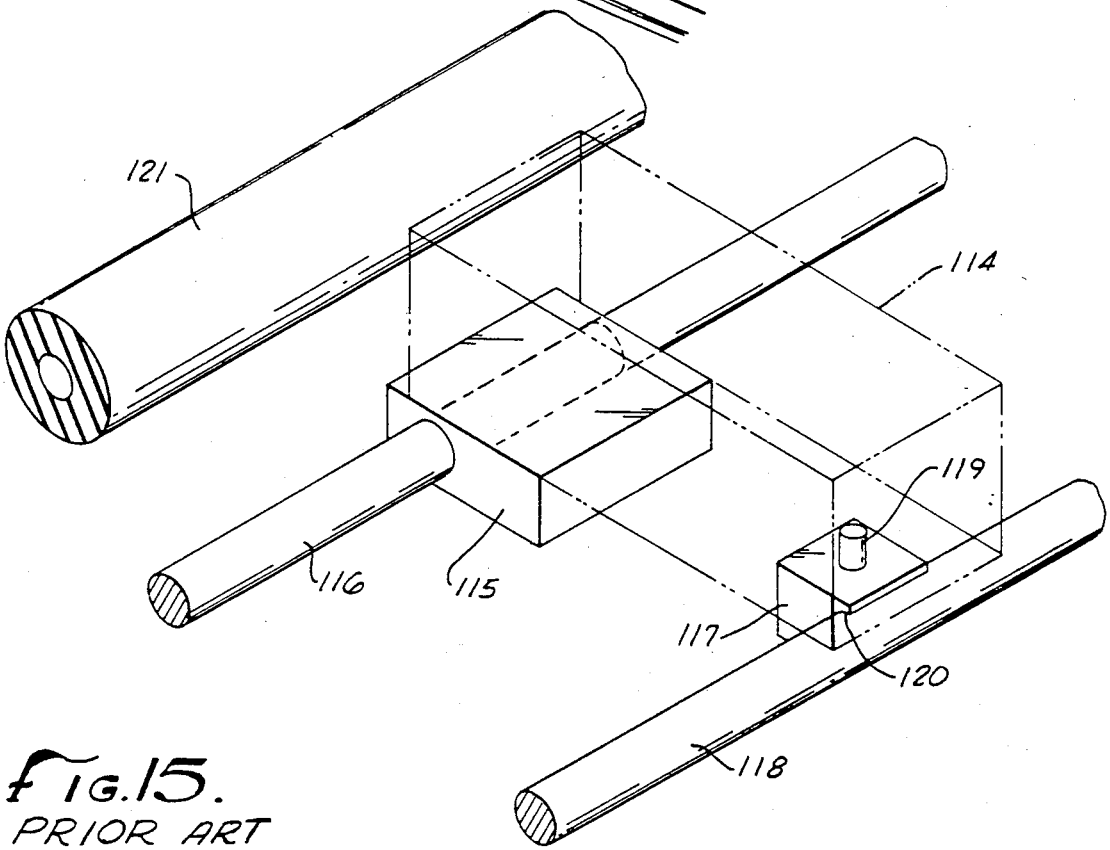
FIG. 15. PRIOR ART
FIG. 15 is a diagrammatic perspective view of a prior art print head carriage assembly.

Another prior art method which is widely used in daisy wheel printers is shown in FIG. 15. There, the location of the print head is indicated by phantom lines 114 and the print head 114 is supported by a bearing block 115 which rides on ground steel shaft 116. A guide bearing block 117 has a semi-circular slot 120 which rides along shaft 118. Guide bearing 117 is held to the platform on which the print head 114 is mounted by a shaft 119. Guide bearing 117 is typically biased to urge the print head 114 in the direction of the platen 121. This mounting system has several important disadvantages. First, the amount of friction between the bearing blocks 115 and 117 and the steel shafts 116 and 118 is sufficient so that print head speed is limited. As stated above, the friction causes heat which causes expansion of the steel shafts 116 and 118 which in turn leads to more friction. This requires larger capacity motors to drive the print head 114. This in turn raises the cost of manufacturing the printer and adds to its overall weight. Also, steel shafts 116 and 118 must be carefully ground for assuring precision movement and such shafts are relatively expensive. Still further, it is necessary for shafts 116 and 118 to be of a relatively large diameter so that they have sufficient strength to prevent any undesired movement of the print head 114. Therefore, they are relatively heavy. For many printers, the additional weight adds a significant cost in transporting the printers. Still further, the steel shafts 116 and 118 must be carefully mounted in the side plates and typically they are mounted in a manner which permits the adjustment of the mounting position. This adjustment can, of course, be done improperly leading to poor performance of the printer.

The present invention eliminates the current design disadvantages and provides a light-weight, low cost and yet highly accurate print carriage assembly. Because of the ball-bearing movement of the linear slide, there is essentially no friction during its movement and high print head speeds do not cause any distortion of the linearity of print head movement. The savings in weight is also significant and the provision of a pre-assembled drop-in unit eliminates any possibility of maladjustment of the carriage mechanism. The present invention may be used in conjunction with impact printers such as daisy wheel printers or with non-impact printers such as an ink jet or electrostatic printers. The apparatus is capable of moving print heads of most known constructions in a highly accurate and precise method.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. In a printing device of the type having a platen mounted on a frame and a moveable print head mounted on a platform of a carriage assembly which is driven in a path parallel to the platen wherein the improvement comprises:

a precision, linear, ball-bearing slide having an outer race member, an inner race member having said platform of said carriage assembly affixed thereto and a ball retainer, said slide being mounted on said frame so that said slide is parallel to said platen;

platen receiving means affixed to said frame;

a support arm affixed to said platform of said carriage assembly;

guide means including channel means which channel means is affixed to said frame, said channel means of said guide means being mounted so that said guide means is parallel to both said platen and said slide, said guide means further having roller means engaging said channel means and said roller means being moveable along said channel means and being rotatably affixed to the support arm of said platform; and biasing means between said inner race member and the roller means of the guide means.

2. The improved printing device of claim 1 wherein said support arm is biased with respect to said carriage assembly so that said support arm urges said carriage assembly away from said guide means and toward said slide.

3. The improved printing device of claim 2 wherein said channel means is a generally "V" shaped channel member.

4. The improved printing device of claim 3 wherein said roller means is a wheel having an outer surface which fits into the generally "V" shaped channel member.

5. The improved printing device of claim 4 wherein said support arm is pivoted at its connection point to said carriage assembly.

6. The improved printing device of claim 1 wherein said outer race member is facing downwardly.

7. The improved printing device of claim 1 wherein said slide is mounted so that its outer race member is mounted horizontally.

8. The improved printing device of claim 1 wherein said ball retainer has synchronizing means to synchronize the movement of the inner race member with respect to the ball retainer.

9. The improved printing device of claim 1 wherein the carriage assembly has an upper platform and a lower platform and said upper and lower platforms are slideably mounted with respect to each other and the upper platform has said support arm affixed thereto.

10. The improved printing device of claim 9 wherein said guide means is movably fixed with respect to said frame and said upper platform is biased toward said guide means.

11. The improved printing device of claim 10 wherein said guide means is rotatable about its longitudinal axis.

12. The improved printing device of claim 1 wherein said printing device is an impact serial printer.

13. The improved printing device of claim 1 wherein said printing device is a non-impact serial printer.

14. A print head and platen unit installable in a printing device, said unit having a platen mounted on a frame and a moveable print head carriage assembly including a platform which assembly is slideable in a path parallel to the platen said unit comprising:

a precision, linear, ball bearing slide having an outer race member, an inner race member having said carriage assembly affixed thereto and a ball retainer, said slide being mounted on said frame so that said slide is parallel to said platen;

platen receiving means affixed to said frame;

a support arm affixed to said platform of said carriage assembly; and guide means including channel means which channel means is affixed to said frame, said channel means of said guide means being mounted so that said guide means is parallel to the both said platen and said slide, said guide means having, in addition to a channel means, a moveable member engaging said channel means and said moveable member being affixed to the support arm of the platform of said carriage assembly.

15. The unit of claim 14 wherein said ball retainer is synchronized with respect to said inner race member.

* * * * *